US005564138A

United States Patent [19]

Simpson

[11] Patent Number: 5,564,138

[45] Date of Patent: Oct. 15, 1996

[54] PORTABLE SHOWER

[75] Inventor: Jefffrey M. Simpson, Wichita, Kans.

[73] Assignee: The Coleman Company, Inc., Wichita, Kans.

[21] Appl. No.: 403,210

[22] Filed: Mar. 17, 1995

[51] Int. Cl.[6] ..... A47K 3/23

[52] U.S. Cl. ..... 4/599; 4/602

[58] Field of Search ..... 4/599, 600, 602, 4/603, 900

[56] References Cited

U.S. PATENT DOCUMENTS 3,391,409 7/1968 Gatley ..... 4/602

3,629,875 12/1971 Dow ..... 4/900 X 4,675,923 6/1987 Ashley ..... 4/900 X 4,975,992 12/1990 Patterson et al. ..... 4/599

*Primary Examiner*—Charles E. Phillips

[57] ABSTRACT

A portable shower includes a base, a frame which is releasably attached to the base and which is provided by a plurality of releasably connected tubes, and a curtain which is supported by the frame. The base is formed from a pair of hingedly connected base portions which are pivotable between a shower position in which the base portions are co-planar to form a water-collecting basin and a storage position in which the base portions are superposed and form a storage case. The tubes of the frame and the curtain can be stored inside of the storage case.

16 Claims, 11 Drawing Sheets

45
46
47
44
29
27
40
50
40
50
25
31
28
38
34
33
26

PORTABLE SHOWER

BACKGROUND

This invention relates to a portable shower, and, more particularly, to a portable shower which provides a base to stand on and a frame which supports a curtain and a water bag.

Campers and other persons who spend time outdoors often have a need or a desire to bathe outdoors. The bathing process is greatly enhanced if the camper can bathe in privacy and has a support surface on which to stand other than bare ground. It will be appreciated that bare ground becomes muddy as water drips onto the ground.

Solar shower bags are commercially available for outdoor bathing. A solar shower bag is a plastic bag which is capable of holding several gallons of water. Exposing the bag to solar radiation heats the water in the bag. However, the solar shower bag does not include any means to support the bag during use, a surface to stand on other than bare ground, or a privacy curtain.

An inflatable enclosure is also commercially available. The enclosure provides privacy but does not provide a surface to stand on or a support for a shower bag.

SUMMARY OF THE INVENTION

The invention provides a portable shower which includes a base or support surface and a frame for supporting a curtain and a water bag. The frame is formed from a plurality of elongated frame members which are removably connected to each other and to the base. The base is foldable into a carrying case in which the frame members, the curtain, and the water bag can be stored.

DESCRIPTION OF THE DRAWING

The invention will be explained in conjunction with an illustrative embodiment shown in the accompanying drawing, in which—

DESCRIPTION OF A SPECIFIC EMBODIMENT

Figure 1:
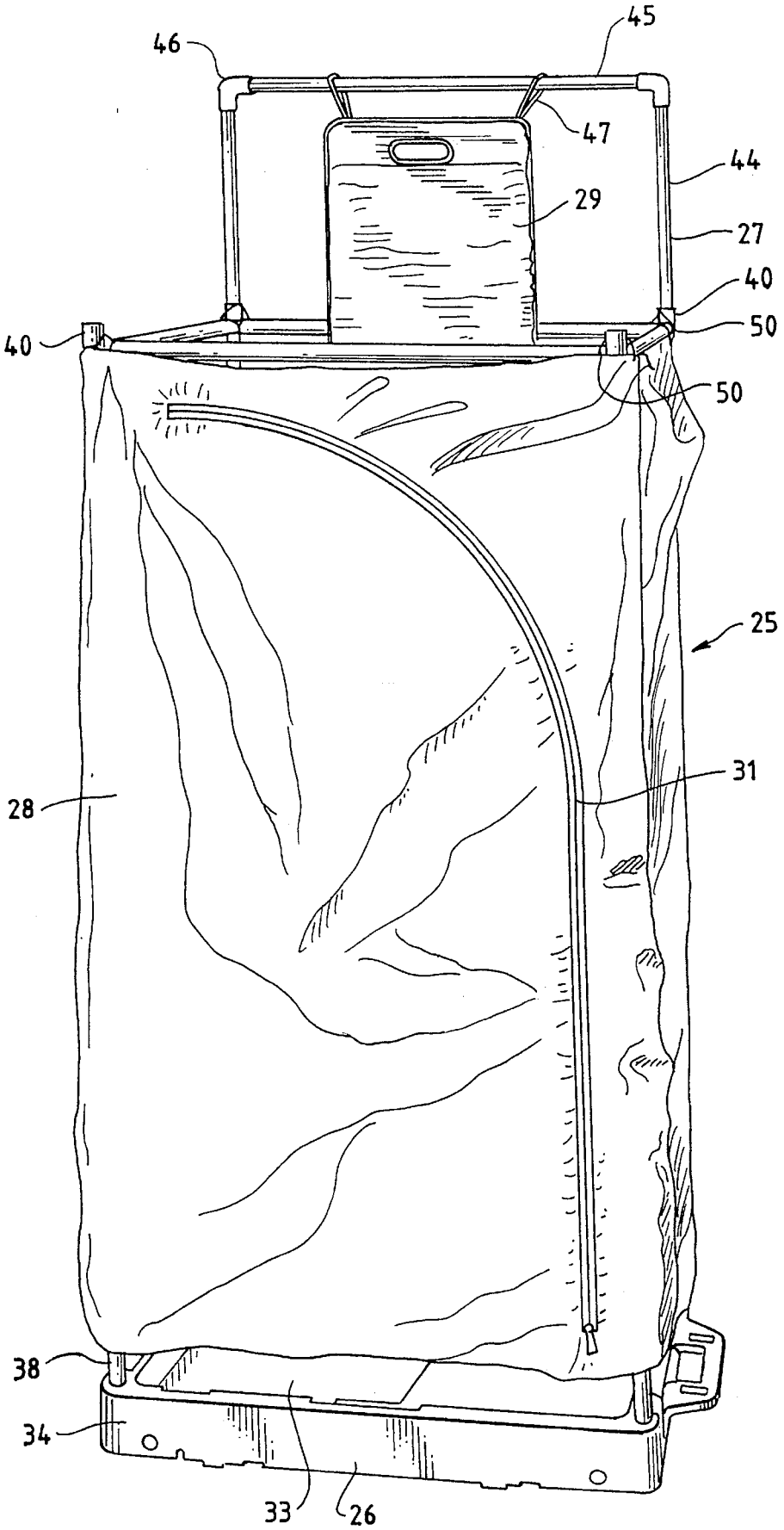
FIG. 1 is a perspective view of a portable shower formed in accordance with the invention.
Figure 2:
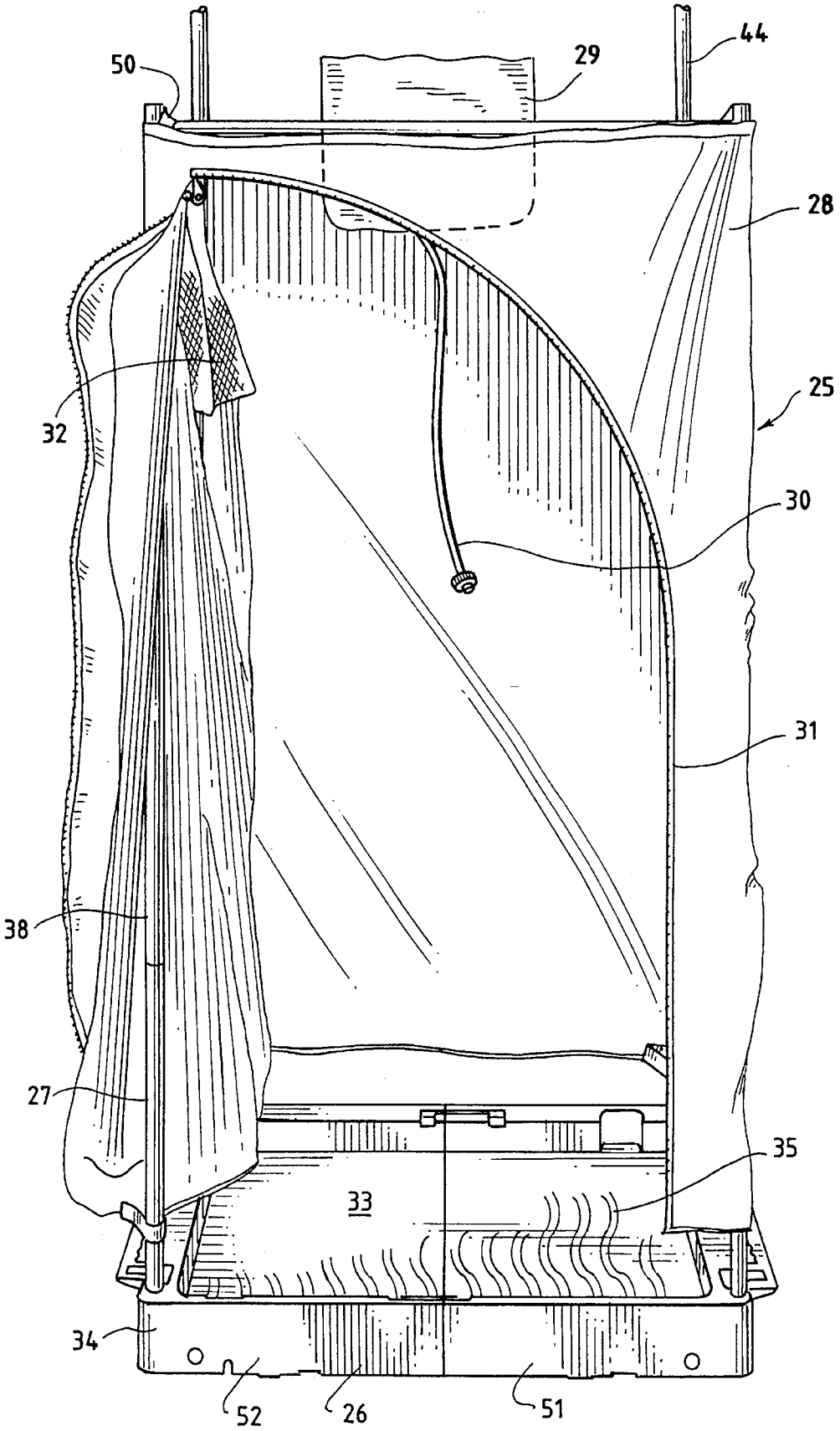
FIG. 2 is a view similar to FIG. 1 showing the access zipper on the curtain unzipped.

Referring to FIGS. 1 and 2, a portable shower 25 includes a base 26, a frame 27, and a curtain 28. A conventional solar shower bag 29 is supported by the frame and includes a drain tube 30 (FIG. 2).

The frame and curtain form a private shower enclosure, and access to the enclosure is provided by a zipper 31 in one of the panels of the curtain. A pair of mesh bags 32 are attached to the inside of the curtain for holding toiletry items or clothes.

The base 26 is rectangular and includes a bottom wall 33 and a rectangular side wall 34 which extends upwardly from the bottom wall. The bottom wall and side wall provide a shower pan or basin for collecting water which drips from the occupant of the shower. The top surface of the bottom wall includes molded-in non-skid strips 35 in the shape of wavy lines. The strips can be provided with a molded-in-textured or gritty top surface.

Figure 4:
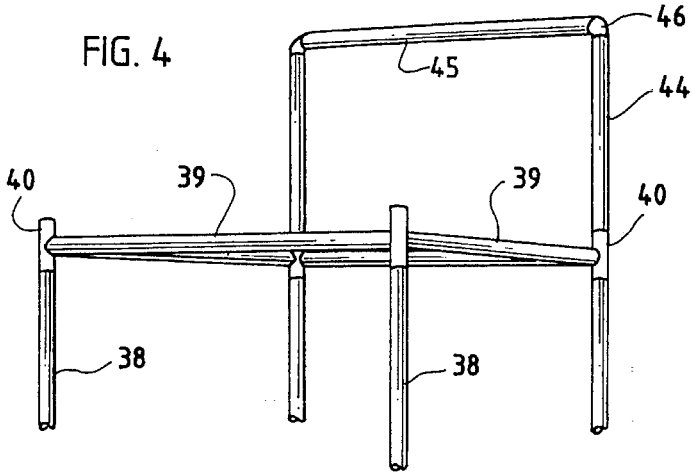
FIG. 4 is a fragmentary perspective view of the upper portion of the frame.

A socket 37 (FIG. 6) is formed in each of the corners of the side wall. The frame includes four elongated, vertically extending supporting frame members 38 which are removably inserted into the sockets and four elongated, horizontal cross frame members 39 (FIG. 4) which extend between the upper ends of the vertical members. In the particular embodiment illustrated, the frame members are cylindrical tubes. However, other types of frame members can be used.

Figure 5:
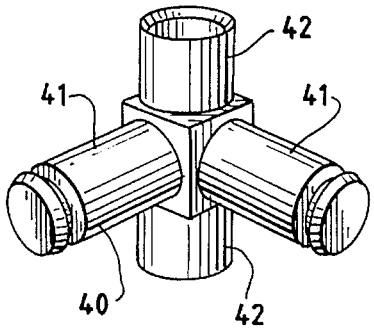
FIG. 5 is a perspective view of one of the frame connectors.

Referring to FIG. 5, the vertical support tubes and horizontal cross tubes are removably interconnected by connectors 40. Each connector includes a pair of right angle male studs 41 which are inserted into a pair of cross tubes 39 and a pair of cylindrical female ends 42. One of the female ends is inserted over the upper end of each of the vertical support tubes.

The frame also includes a bag-support superstructure which is formed by a pair of vertical rods or tubes 44 and a horizontal cross tube 45. The vertical tubes 44 and cross tube 45 are removably connected by elbows 46, and the vertical rods 44 are removably inserted into the female ends of two of the connectors 40. Alternatively, the elbows 46 could be formed integrally with the cross tube 45. The shower bag is hung from the cross tube 45 by a pair of hooks 47.

The curtain 28 is formed from four rectangular panels, and a strap 50 (FIG. 1) is attached to the upper end of each corner. The curtain is supported on the frame by looping the straps over the upper ends of the corner connectors 40.

The base 26 includes a pair of base portions or base halves 51 and 52 which are hingedly secured by a piano hinge 53

Figure 6:
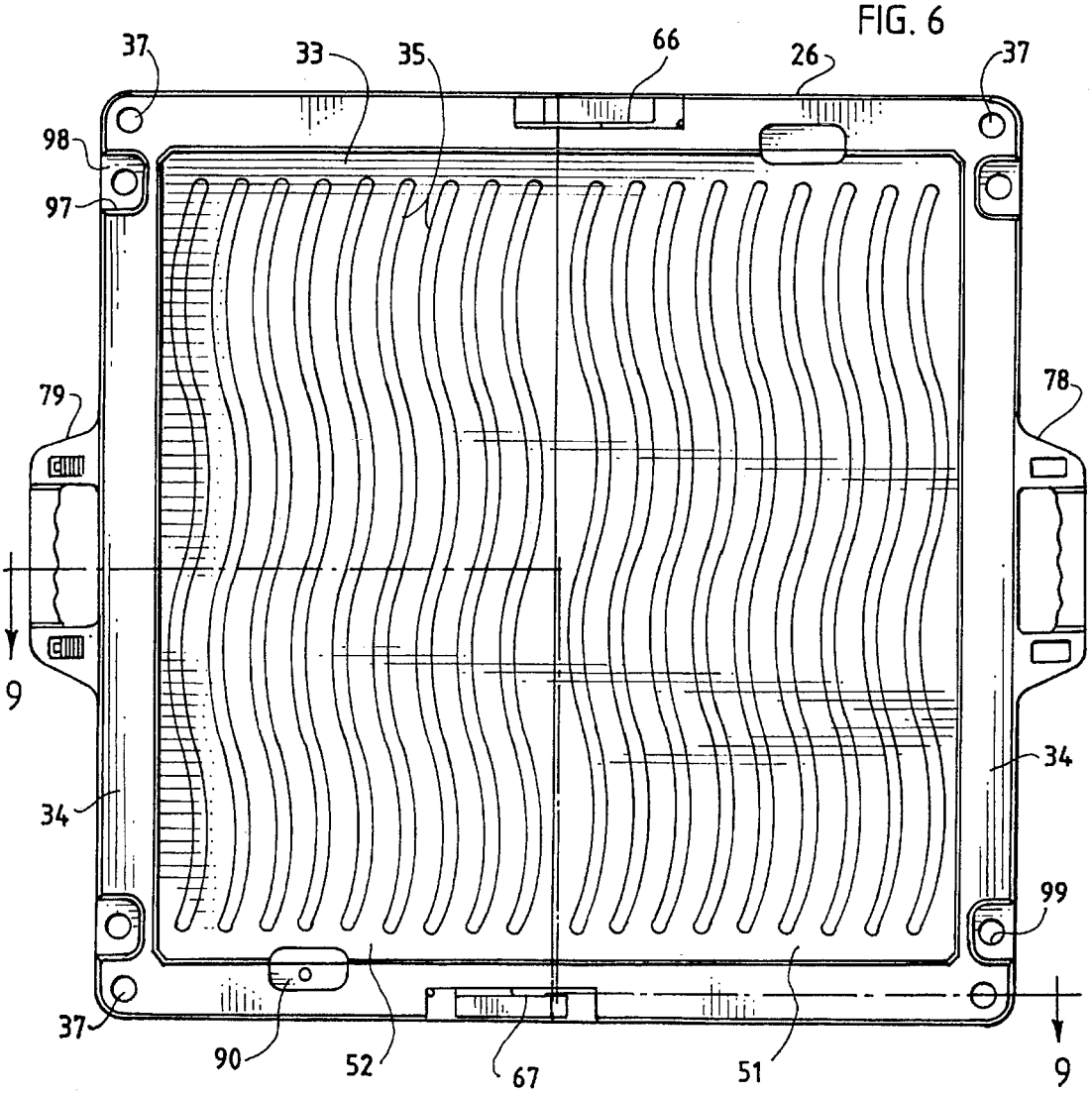
FIG. 6 is a top plan view of the base of the shower.
Figure 7:
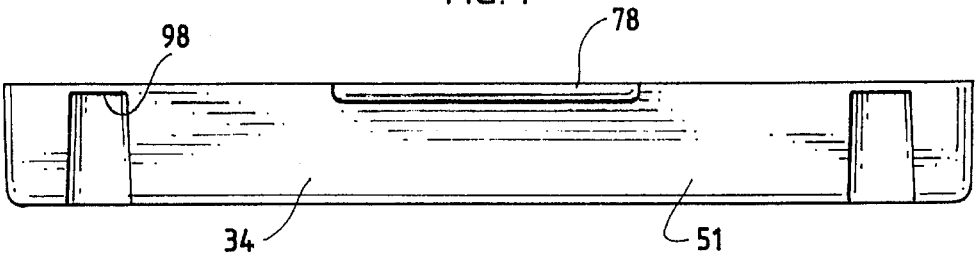
FIG. 7 is a side elevational view of the base taken along the line 7—7 of FIG. 6.
Figure 8:
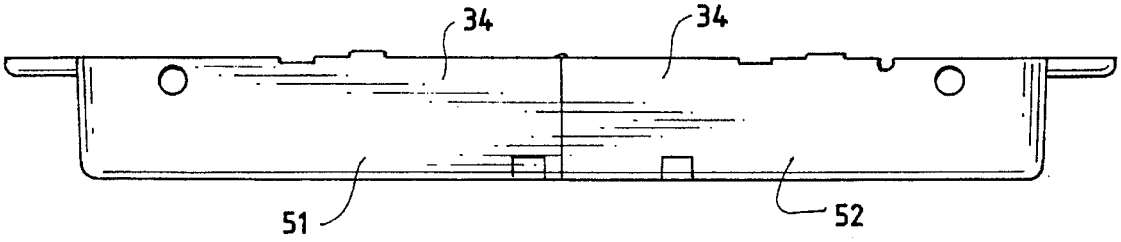
FIG. 8 is a side view taken along the line 8—8 of FIG. 6.
Figure 9:
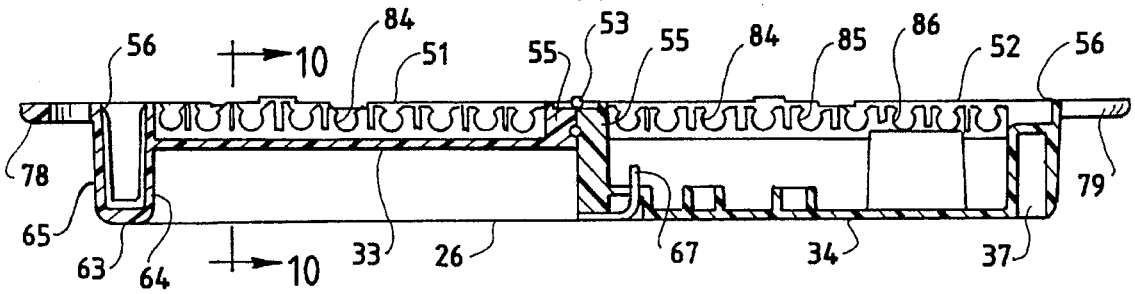
FIG. 9 is a sectional view taken along the line 9—9 of FIG. 6.
Figure 11:
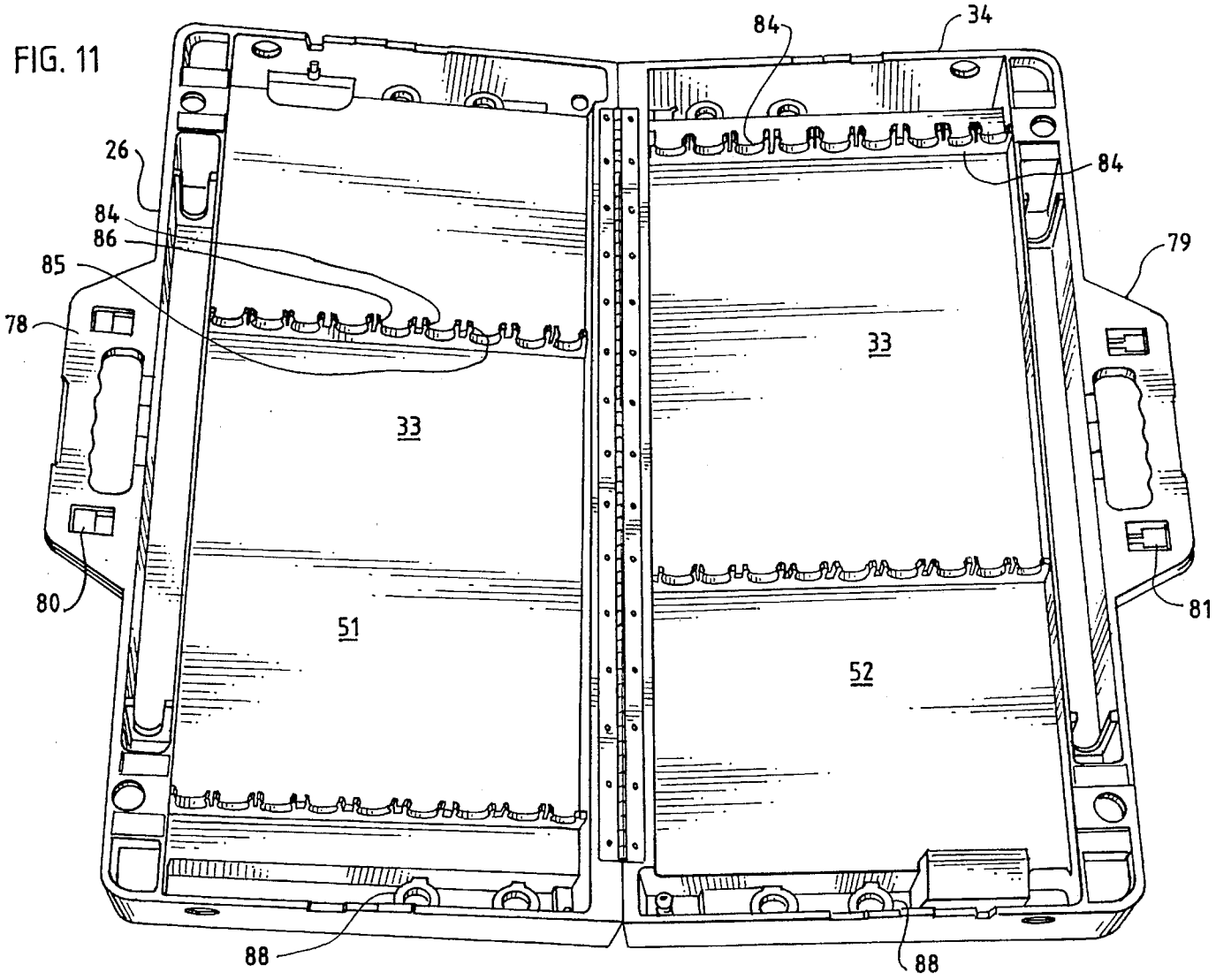
FIG. 11 is a bottom perspective view of the base.

(FIGS. 9 and 11). The hinge is secured to a support foot 55 which extends downwardly from the bottom wall 33 of each of the base portions. When the bottom walls 33 are co-planar as illustrated in FIG. 6, 9, and 11, the bottom of each of the support feet 55 is level with the bottom edge 56 of the side wall. The support feet 55 and the bottom edges 56 support the base on the ground or other generally flat surface.

Figure 13:
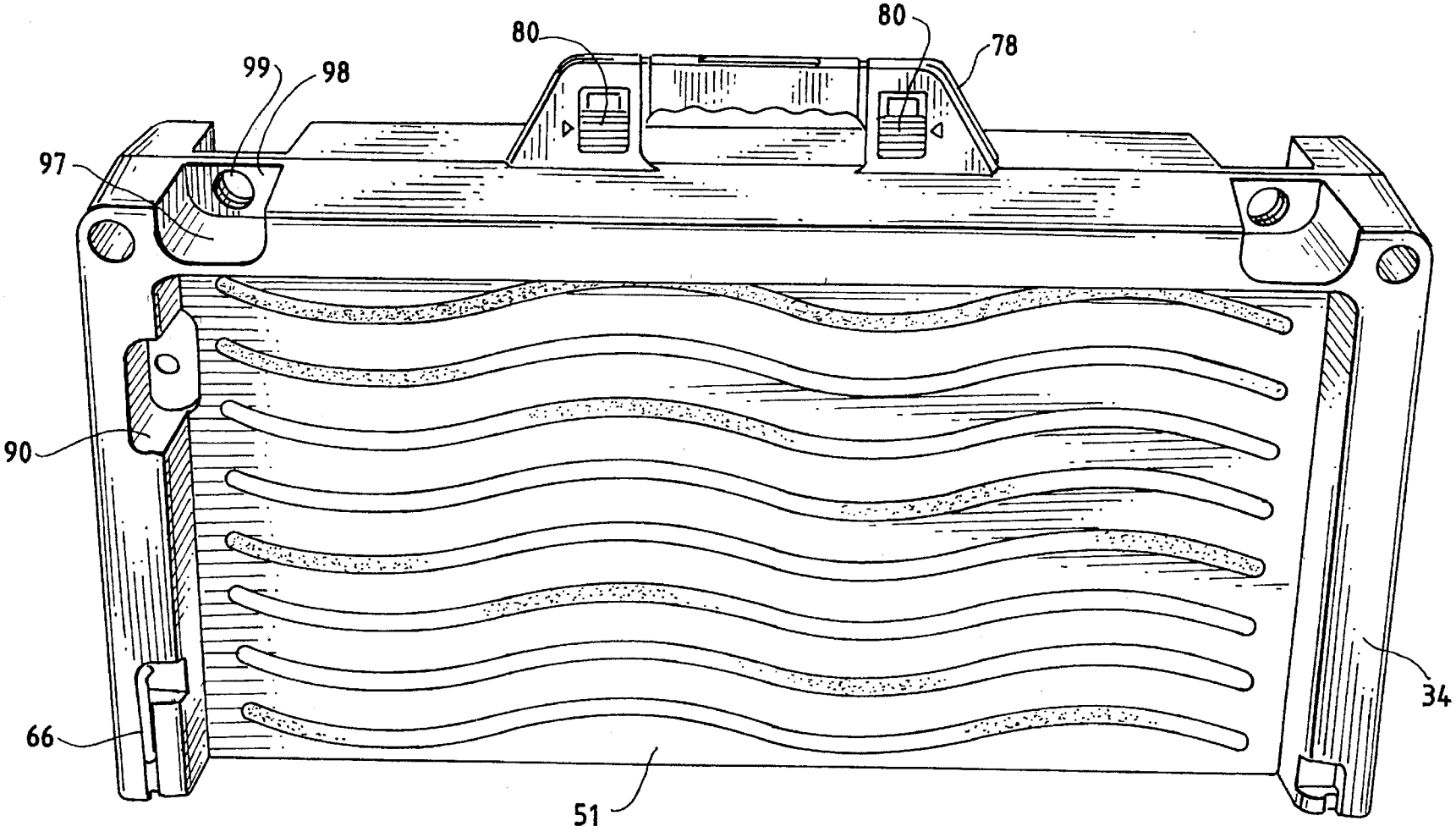
FIG. 13 is a perspective view of the base folded into a carrying case.
Figure 15:
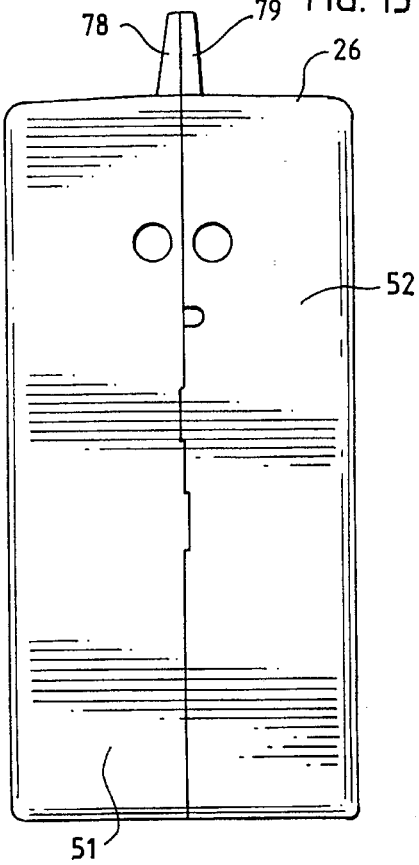
FIG. 15 is a side elevational view of the carrying case of FIG. 13.

The hinge 53 permits the base portion to be pivoted between the use or shower position illustrated in FIG. 6, 9, and 11 and a position illustrated in FIGS. 13 and 15 in which the base portions are superposed. As will be explained more fully hereinafter, in the configuration illustrated in FIGS. 13 and 15, the base portions form a storage and carrying case for the curtain and the rods which form the frame.

Figure 14:
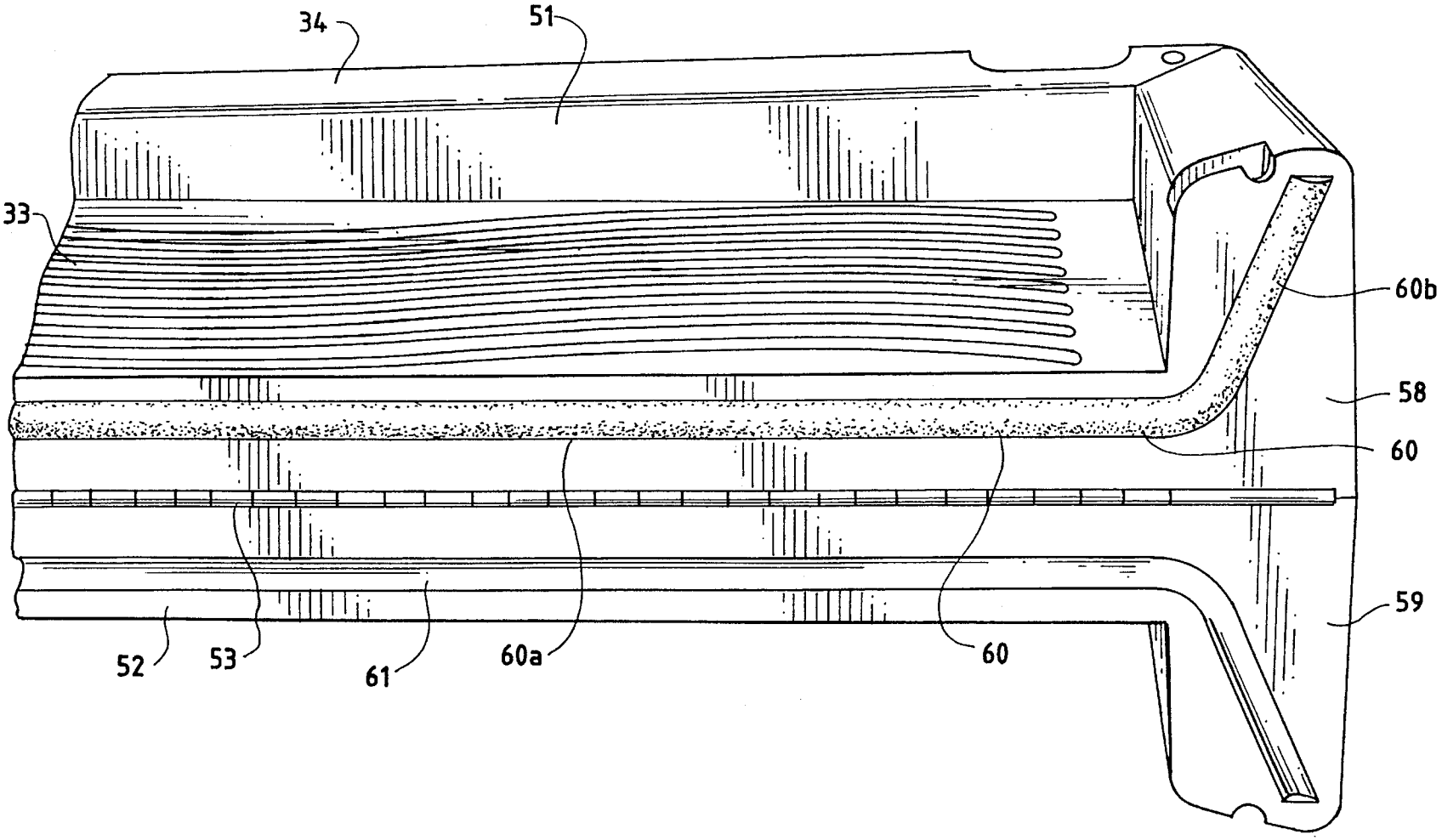
FIG. 14 is a fragmentary bottom view of the carrying case of FIG. 13.

The base portions 51 and 52 include mating faces 58 and 59 (FIG. 14) which abut when the base portions are unfolded to the shower position. A bulb seal or gasket 60 is secured to the face 58, and the gasket mates with and sealingly engages a groove 61 in the face 59. The gasket includes a central portion 60*a* which extends along the bottom wall 33 and a pair of end portions 60*b* which extend upwardly along the side walls 34.

Figure 16:
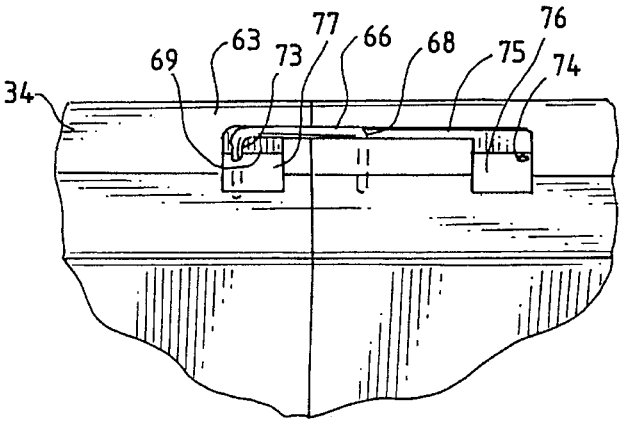
FIG. 16 is a fragmentary view showing one of the latches for the base.
Figure 17:
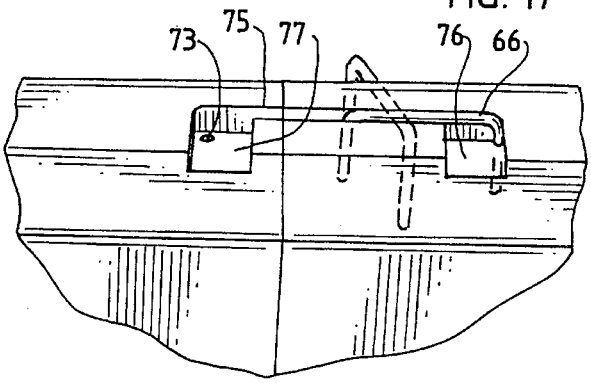
FIG. 17 is a view similar to FIG. 16 showing the latch in the unlatched position.
Figure 18:
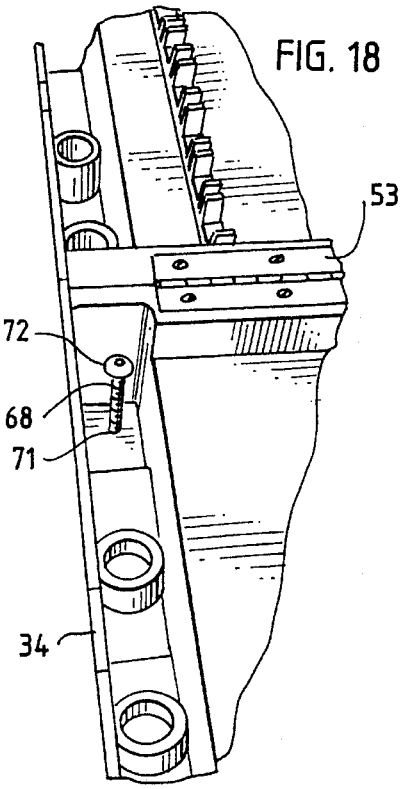
FIG. 18 is a fragmentary bottom perspective view showing one of the latches for the base.

The side wall 34 of each of the base portions is generally channel-shaped or U-shaped in cross section (FIGS. 9 and 11) and includes a top portion 63 and a pair of inner and outer side portions 64 and 65. The base portions are releasably latched in the shower position by a pair of latches 66 and 67 (FIGS. 9, 16, and 17). The latch 66 is generally U-shaped and includes a mounting leg 68 which extends through an opening in the top portion 63 of the side wall of the base portion 51, a latching leg 69, and a connecting leg 70. As can be seen in FIG. 18, the mounting leg 68 extends below the top portion 63 of the side wall, and a compression spring 71 resiliently biases the connecting leg 70 against the top of the side wall. An end cap 72 retains the spring 71 on the leg 68.

The latch 67 is movable between a latch position illustrated in FIG. 16 in which the latching leg 69 extends into an opening 73 in the side wall of the base portion 52 and an unlatched position illustrated in FIG. 17 in which the latching leg 69 extends into an opening 74 in the side wall of the base portion 51. In either position the connecting leg is positioned in a groove 75 in the top of the side wall. A pair of recesses 76 and 77 facilitate lifting the latch from the openings 73 or 74. The latch 67 is movably mounted on the base portion 52 on the opposite side of the base and operates in the same way.

The base portions 51 and 52 are latched in the storage position illustrated in FIGS. 13 and 15 by latches which are mounted on handles 78 and 79 which extend outwardly from the side walls of the base portions 51 and 52. A pair of male latches 80 are slidably mounted on the handle 78 (FIGS. 11 and 13), and a pair of female latches 81 are mounted on the handle 79. Each male latch includes a projection which slides into a catch on the female latch when the male latch is moved to its latching position.

Referring to FIG. 9 and 11, a plurality of retaining clips 84 extend downwardly from the bottom surface of each of the bottom walls 33. Each clip includes a pair of legs, and each leg includes a curved portion 85 and a retaining shoulder 86. The retaining clips are advantageously molded integrally with the base portions from suitable plastic material, and the legs are flexible and resilient.

Figure 12:
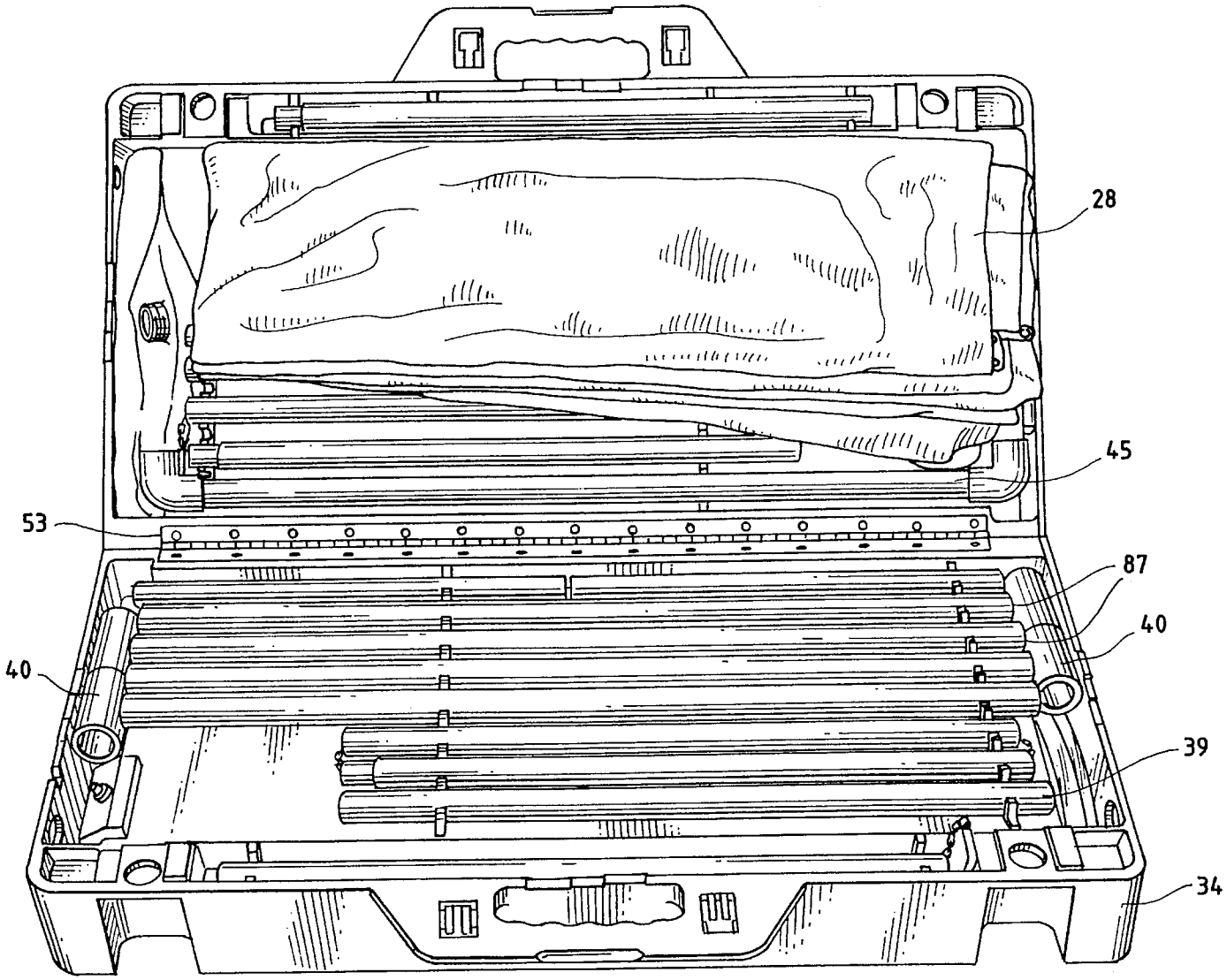
FIG. 12 is a perspective view of the base showing the components of the shower stored in the base.

Each of the vertical tubes 38 of the frame is advantageously formed from a plurality of shorter tubes 87 (FIG. 12) which can be telescopingly fitted together. The tubes 87, the cross tubes 39, and the tubes 44 and 45 are stored within the base portions by inserting the tubes into the clips as shown in FIG. 12.

The recesses of the hollow side walls 34 of the base portions provide storage for the tube connectors 40, the water bag 29, and some of the tubes. Rings 88 (FIG. 11) are molded into the recesses for holding the connectors. The curtain 28 can be folded and stored on top of the tubes in one of the base portions.

The outer side portions 65 (FIG. 9) of the side wall 34 extend beyond the tubes, and when the base portions are folded to the closed or storage position, the tubes and the curtain are completely enclosed by the mating side portions 65 of the two base portions (FIG. 15). The case formed by the folded and latched base portions can be conveniently carried by the handles 78 and 79.

Figure 10:
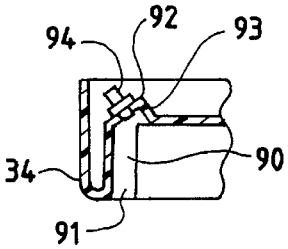
FIG. 10 is a fragmentary sectional view taken along the line 10—10 of FIG. 6.
Figure 19:
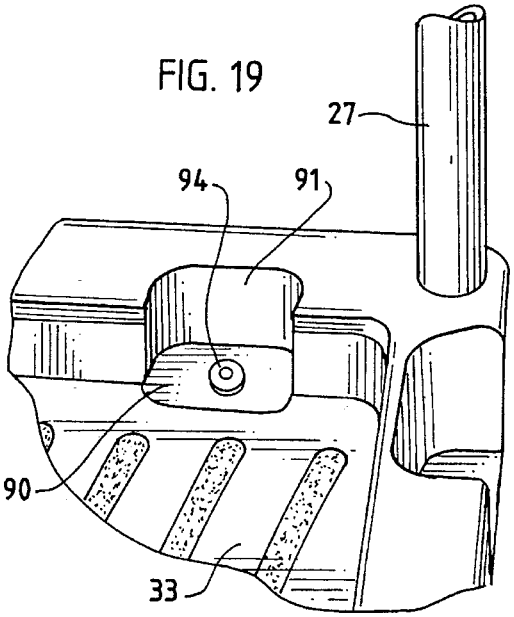
FIG. 19 is a fragmentary perspective view showing the drain sump of the base.
Figure 20:
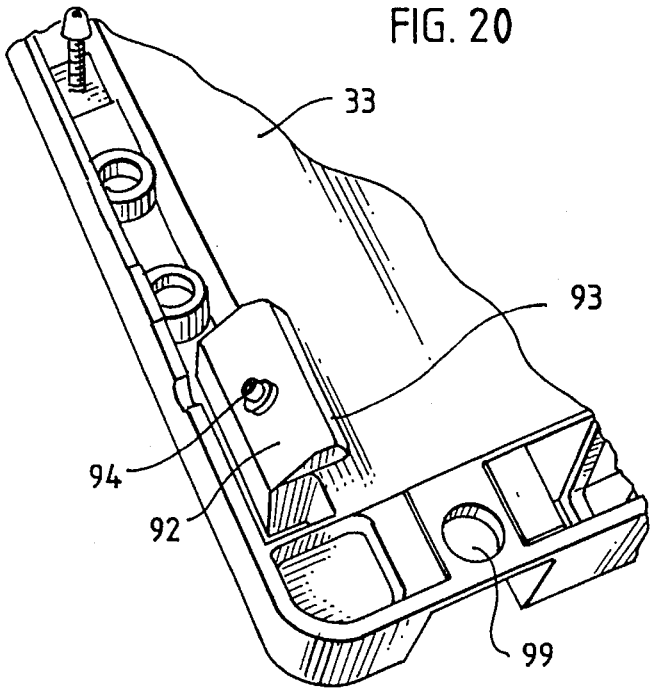
FIG. 20 is a bottom fragmentary perspective view of the drain sump.
Figure 21:
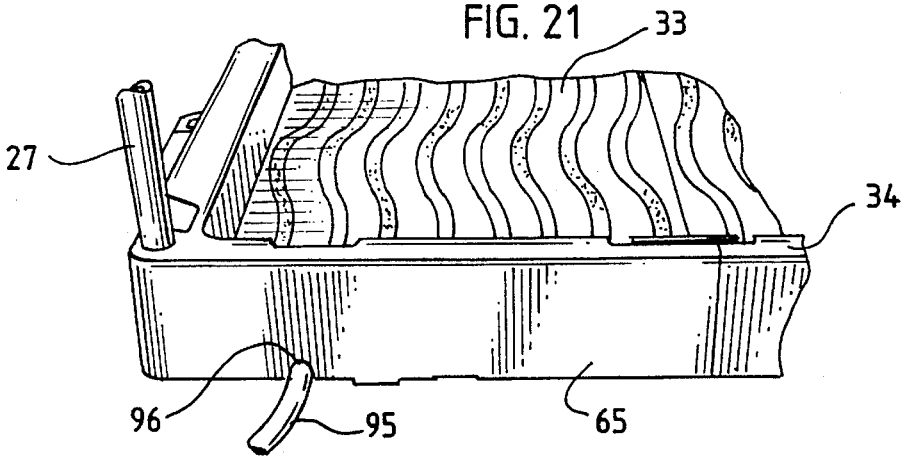
FIG. 21 is a fragmentary side perspective view showing the drain tube.

The base portion 51 is provided with a drain sump 90 (FIGS. 10, 19, and 20). The drain sump is provided by a recess 91 in the side wall 34 and a pair of inclined bottom walls 92 and 93 which extend below the bottom wall 33. A plastic tubular drain fitting 94 extends through an opening in the bottom wall 92. A drain tube 95 (FIG. 21) can be attached to the fitting and can extend through a recess 96 in the outer portion 65 of the side wall.

Figure 22:
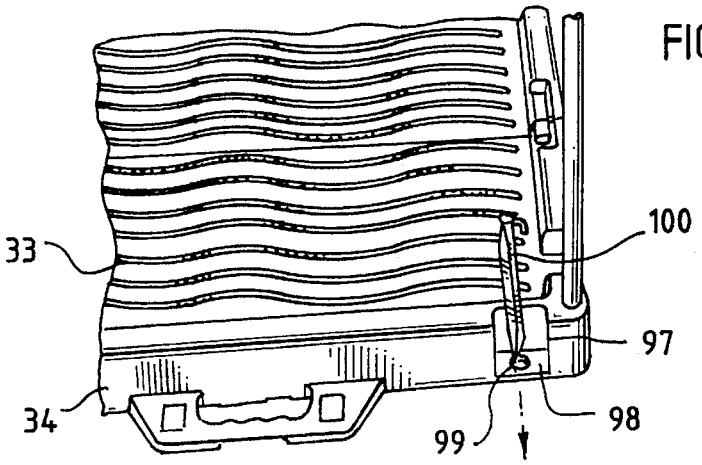
FIG. 22 is a fragmentary side perspective view showing a stake being inserted through one of the stake openings.

A stake recess 97 (FIGS. 19 and 22) is provided in the side wall adjacent each of the corners. The recess terminates in a bottom wall 98 which is provided with an opening 99. A tent stake 100 can be inserted through each of the openings and driven into the ground to secure the base.

All of the components of the shower can be stored within the case provided by the base portions, and the case is conveniently transported by the handles. When the shower is to be used, the case is unlatched and opened (FIG. 12). The components which are stored in the case are removed, and the drain tube 95 is attached to the drain fitting 94 of the sump. The bottom surfaces of the base portions are positioned on the ground, and the base portions are latched open by the latches 66 and 67.

Figure 3:
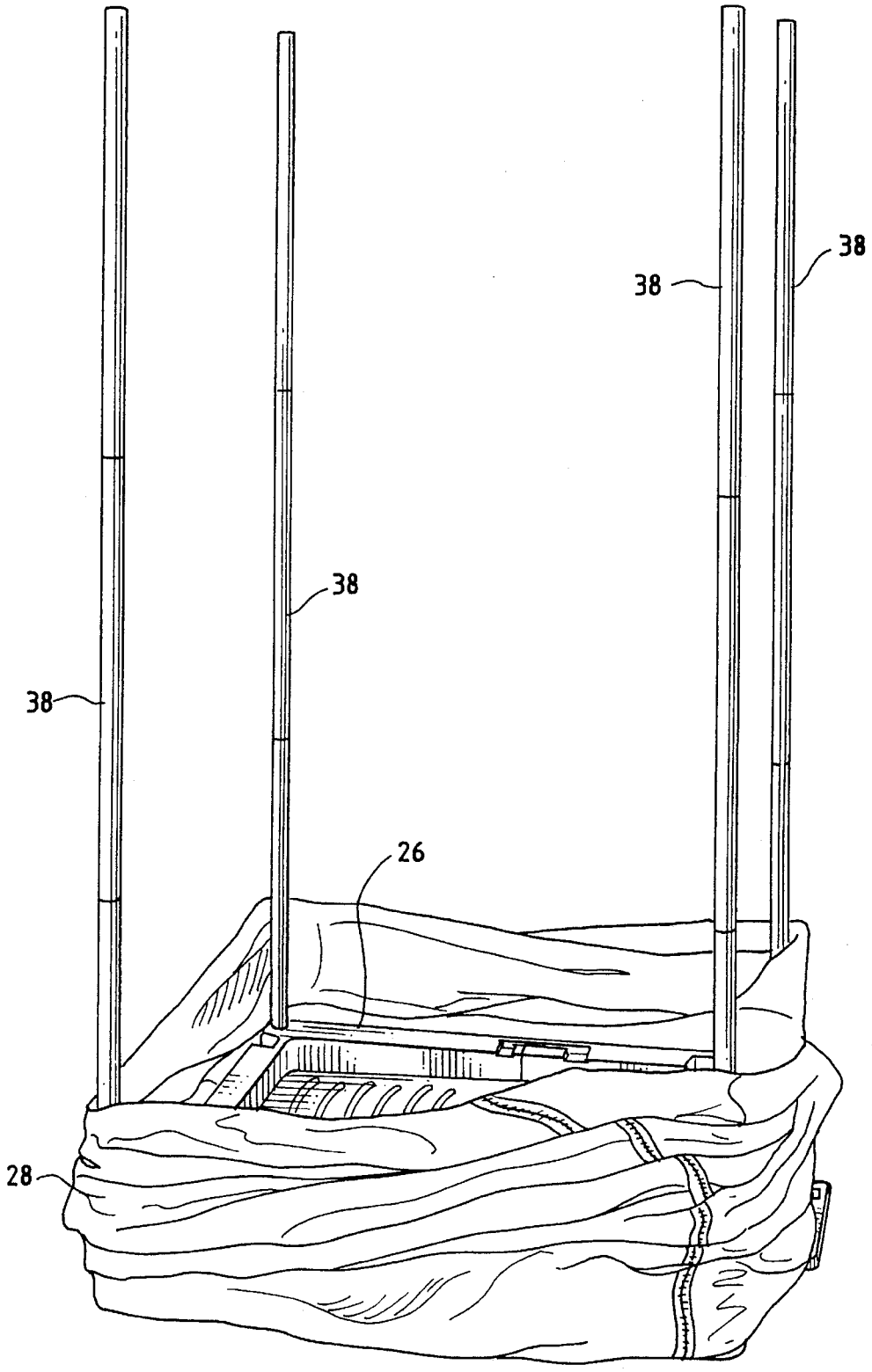
FIG. 3 is a perspective view showing the shower in the process of being erected.

The shower curtain 28 is positioned around the base as illustrated in FIG. 3. The vertical tubes 38 are assembled and inserted into the sockets in the base, and the cross tubes 39 are connected to each other and to the vertical tubes by the connectors 40. The curtain is then pulled up over the tubes 38 and attached to the connectors by the straps 51. The superstructure 44–45 is assembled and mounted on the connectors, and the bag 29 is hooked to the cross rod 45. If desired, the base can be secured by the stakes 100. The bather steps into the private shower enclosure provided by the curtain and stands on the base while water flows from the water bag. Waste water can be directed to the desired location by the drain tube.

While in the foregoing specification a detailed description of specific embodiments of the invention was set forth for the purpose of illustration, it will be understood that many of the details herein given can be varied considerably by those skilled in the art without departing from the spirit and scope of the invention.

I claim:

1. A portable shower comprising:

a base formed from a pair of hingedly connected base portions, each base portion including a bottom wall and a side wall, the base portions being pivotable between a shower position in which the bottom walls are substantially co-planar and the base portions form a water-collecting basin and a storage position in which the bottom walls are superposed and form a storage case, a latch on one of the base portions which is releasably engageable with the other base portion for latching the base portions in the shower position, a frame supported by the base and removably attached thereto, the frame being formed by a plurality of elongated frame members extending upwardly from the base, each of the upwardly extending frame members having a lower end removably attached to the base and an upper end, and a plurality of cross frame members extending between the upper ends of the upwardly extending frame members and removably connected thereto, and a curtain supported by the frame and forming a shower enclosure.

2. The shower of claim 1 in which the latch is generally U-shaped and includes an elongated mounting leg which is pivotally mounted in the side wall of said one base portion, a latching leg which is generally parallel to the mounting leg and which is insertable into an opening in the side wall of the other base portion, and a connecting leg which extends between the mounting leg and the latching leg.

3. The shower of claim 2 in which the side wall of said one base portion includes a top portion, the connecting leg being positioned above the top portion of the side wall and the mounting leg extending from the connecting leg through the top portion of the side wall, and a spring on the mounting leg below the top portion of the side wall resiliently biasing the connecting leg toward the top portion of the side wall.

4. A portable shower comprising:

a base, a frame supported by the base and removably attached thereto, the frame being formed by a plurality of elongated frame members extending upwardly from the base, each of the upwardly extending frame members having a lower end removably attached to the base and an upper end, and a plurality of cross frame members extending between the upper ends of the upwardly extending frame members and removably connected thereto, and a curtain supported by the frame and forming a shower enclosure, the base being generally rectangular and including four corners, each of the corners being provided with an opening, each of the upwardly extending frame members being inserted into one of the openings and extending generally vertically upwardly therefrom generally parallel to the other support rods, the cross frame members extending generally horizontally and perpendicularly to the upwardly extending frame members, and a bag-support frame removably attached to the frame, the bag-support frame including a pair of generally vertical bag frame meters which are removably connected to the upper ends of two of the upwardly extending frame members and extend upwardly therefrom and a cross bag frame member which extends generally horizontally between the vertical bag frame members and which is removably connected thereto.

5. A portable shower comprising:

a base and a frame supported by the base and removably attached thereto, the frame being formed by a plurality of tubes, the base being formed from a pair of hingedly connected base portions, each base portion including a bottom wall and a side wall, the base portions being pivotable between a shower position in which the bottom walls are substantially co-planar and the base portions form a water-collecting basin and a storage position in which the bottom walls are superposed and form a storage case, each of the base portions including a top surface and a bottom surface, and tube-holding means on the bottom surface of at least one of the base portions for releasably holding the tubes of the frame.

6. The shower of claim 5 in which the tube-holding means includes a plurality of clips which releasably clamp the rods.

7. A portable shower comprising:

a base portion and a frame supported by the base and removably attached thereto, the frame being formed by a plurality of tubes, the base being formed from a pair of hingedly connected base portions, each base portion including a bottom wall and a side wall, the base portions being pivotable between a shower position in which the bottom walls are substantially co-planar and the base portions form a water-collecting basin and a storage position in which the bottom walls are superposed and form a storage case, and a gasket on one of the base portions which sealingly engages the other base portion when the base portions are in the shower position.

8. A portable shower comprising:

a base formed from a pair of hingedly connected base portions, each base portion including a bottom wall and a side wall, the base portions being pivotable between a shower position in which the bottom walls are substantially co-planar and the base portions form a water-collecting basin and a storage position in which the bottom walls are superposed and form a storage case, a frame supported by the base and removably attached thereto, the frame being formed by a plurality of elongated frame members extending upwardly from the base, each of the upwardly extending frame members having a lower end removably attached to the base and an upper end, and a plurality of cross frame members extending between the upper ends of the upwardly extending frame members and removably connected thereto, a curtain supported by the frame and forming a shower enclosure, each of the base portions including a top surface and a bottom surface, and means on the bottom surface of at least one of the base portions for releasably holding the frame members.

9. The shower of claim 8 in which the means for holding the frame members includes a plurality of clips which releasably clamp the frame members.

10. A portable shower comprising:

a base formed from a pair of hingedly connected base portions, each base portion including a bottom wall and a side wall, the base portions being pivotable between a shower position in which the bottom walls are substantially co-planar and the base portions form a water-collecting basin and a storage position in which the bottom walls are superposed and form a storage case, a frame supported by the base and removably attached thereto, the frame being formed by a plurality of elongated frame members extending upwardly from the base, each of the upwardly extending frame members having a lower end removably attached to the base and an upper end, and a plurality of cross frame members extending between the upper ends of the upwardly extending frame members and removably connected thereto, a curtain supported by the frame and forming a shower enclosure, a gasket on one of the base portions which sealingly engages the other base portion when the base portions are in the shower position.

11. The shower of claim 10 in which the other base portion is provided with a recess which receives the gasket when the base portions are in the shower position.

12. The shower of claim 10 in which the gasket extends along the bottom wall and upwardly into the side walls of said one base portion.

13. A method of erecting a portable shower comprising the steps of:

opening a case having a pair of hingedly connected case portions, each of the case portions having outer and inner surfaces, removing a plurality of frame members from the inner surface of at least one of the case portions, positioning the case portions so that the inner surfaces are supported by a supporting surface and the outer surfaces face upwardly and form a water-collecting basin, and inserting the frame members into openings in the case portions so that the frame members extend upwardly therefrom.

14. The method of claim 13 including the steps of removing a curtain from the inner surface of at least one of the case portions and supporting the curtain on the upwardly extending frame members.

15. The method of claim 13 including the steps of releasably latching the case portions when the outer surfaces face upwardly so that the outer surfaces are generally co-planar.

16. The method of claim 13 including the step of supporting a water bag on the upwardly extending frame members.

* * * * *

UNITED STATES PATENT AND TRADEMARK OFFICE

CERTIFICATE OF CORRECTION

PATENT NO. : 5,564,138

DATED : October 15, 1996

INVENTOR(S) : Jeffrey M. Simpson

It is certified that error appears in the above-indentified patent and that said Letters Patent is hereby corrected as shown below:

Col. 5, line 52 change "meters" to --members--.

Signed and Sealed this

Seventeenth Day of December, 1996

*Attest:*

*Attesting Officer*

BRUCE LEHMAN

*Commissioner of Patents and Trademarks*